US010780485B2

(12) United States Patent
Kohno

(10) Patent No.: US 10,780,485 B2
(45) Date of Patent: Sep. 22, 2020

(54) DIE CUSHION DEVICE

(71) Applicant: AIDA ENGINEERING, LTD., Kanagawa (JP)

(72) Inventor: Yasuyuki Kohno, Kanagawa (JP)

(73) Assignee: AIDA ENGINEERING, LTD., Kanagawa (JP)

( * ) Notice: Subject to any disclaimer, the term of this patent is extended or adjusted under 35 U.S.C. 154(b) by 193 days.

(21) Appl. No.: 15/905,702

(22) Filed: Feb. 26, 2018

(65) Prior Publication Data

US 2018/0243811 A1 Aug. 30, 2018

(30) Foreign Application Priority Data

Feb. 27, 2017 (JP) ..... 2017-035058

(51) Int. Cl.

*B21D 24/02* (2006.01)
*B30B 15/16* (2006.01)
*B30B 15/02* (2006.01)

(52) U.S. Cl.

CPC ..... *B21D 24/02* (2013.01); *B30B 15/02* (2013.01); *B30B 15/16* (2013.01)

(58) Field of Classification Search

CPC ..... B21D 24/14; B21D 24/02; F15B 1/024; B30B 15/16; B30B 15/02; B30B 15/062
USPC ..... 72/453.13; 100/269.01, 269.14
See application file for complete search history.

(56) References Cited

U.S. PATENT DOCUMENTS 4,593,547 A 6/1986 Heiberger
4,669,298 A 6/1987 Kono et al.
5,140,895 A * 8/1992 Imanishi ..... B21D 24/02 100/269.14

(Continued)

FOREIGN PATENT DOCUMENTS

CN 2694019 Y 4/2005
DE 3223517 A1 * 12/1983 ..... B30B 15/16

(Continued)

OTHER PUBLICATIONS

Non-Final Office Action issued in U.S. Appl. No. 14/704,469, dated Jun. 22, 2016.

(Continued)

*Primary Examiner* — Adam J Eiseman
*Assistant Examiner* — Dylan Schommer
(74) *Attorney, Agent, or Firm* — McDermott Will & Emery LLP

(57) ABSTRACT

To provide a die cushion device which is inexpensive, functional, and capable of locking completely (at or below the slide bottom dead center). The die cushion device includes a cushion pad, a hydraulic cylinder that moves the cushion pad up and down, and a hydraulic closed circuit connected to a die cushion pressure generation chamber of the hydraulic cylinder. The hydraulic closed circuit includes a cushion pad lowering pressure generation line and a second system pressure line in addition to a die cushion pressure generation line and a first system pressure line. When the cushion pad is locked at the bottom dead center, the cushion pad lowering pressure generation chamber is connected to the first system pressure line, and the die cushion pressure generation chamber is connected to the second system pressure line such that the cushion pad is held at or below the slide bottom dead center.

14 Claims, 7 Drawing Sheets

(56) References Cited

U.S. PATENT DOCUMENTS

| | | | | |
|---|---|---|---|---|
| 5,638,748 | A | 6/1997 | Daniel | |
| 5,644,915 | A | 7/1997 | Dressing et al. | |
| 5,701,778 | A | 12/1997 | Kirii | |
| 6,205,828 | B1 | 3/2001 | Nagao et al. | |
| 8,850,865 | B2 | 10/2014 | Miyasaka et al. | |
| 9,782,816 | B2 * | 10/2017 | Kohno | B21D 24/14 |
| 2004/0107699 | A1 * | 6/2004 | Fales | F15B 11/006 60/414 |
| 2006/0108185 | A1 | 5/2006 | Bitter | |
| 2006/0254337 | A1 * | 11/2006 | Arns | B21D 24/02 72/351 |
| 2009/0071218 | A1 * | 3/2009 | Kohno | B21D 24/02 72/351 |
| 2009/0158810 | A1 * | 6/2009 | Kohno | B21D 24/02 72/453.13 |
| 2011/0226141 | A1 * | 9/2011 | Kohno | B21D 24/02 100/269.01 |
| 2015/0360274 | A1 * | 12/2015 | Kohno | B21D 24/02 72/20.2 |

FOREIGN PATENT DOCUMENTS

| | | | |
|---|---|---|---|
| JP | 07024600 | A * | 1/1995 |
| JP | H0747196 | Y2 * | 11/1995 |
| JP | 2001-79694 | A | 3/2001 |
| JP | 2016-000407 | A | 1/2016 |

OTHER PUBLICATIONS

Final Office Action issued in U.S. Appl. No. 14/704,469, dated Nov. 28, 2016.

Notice of Allowance issued in U.S. Appl. No. 14/704,469, dated Jun. 1, 2017.

* cited by examiner

RELATED ART

DIE CUSHION DEVICE

CROSS-REFERENCE TO RELATED APPLICATIONS

The present application claims priority under 35 U.S.C. § 119 to Japanese Patent Application No. 2017-035058, filed on Feb. 27, 2017. The above application is hereby expressly incorporated by reference, in its entirety, into the present application.

BACKGROUND OF THE INVENTION

Field of the Invention

The present invention relates to a die cushion device, and more particularly to an inexpensive and functionally efficient die cushion device.

Description of the Related Art

Conventionally, as an inexpensive and functional die cushion device, a die cushion device has been proposed in Japanese Patent Application Laid-Open No. 2016-407 (hereinafter referred to as Patent Document 1).

The die cushion device includes a cushion pad, a hydraulic cylinder for moving the cushion pad up and down, and a hydraulic closed circuit connected to a die cushion pressure generation chamber of the hydraulic cylinder. The hydraulic closed circuit has: a pilot drive type logic valve operable as a main relief valve during die cushion process; and a pilot relief valve for generating pilot pressure for controlling the logic valve. In addition, hydraulic oil is filled in a pressurized manner in the hydraulic closed circuit.

Hydraulic oil filled in a pressurized manner in the hydraulic closed circuit is pressurized only by die cushion force applied from the cushion pad via the hydraulic cylinder during one cycle period of the cushion pad including a die cushion process and a knockout process, and is accumulated in an accumulator as low-pressure system pressure capable of the knockout process. The hydraulic oil accumulated in the accumulator is supplied to the die cushion pressure generation chamber of the hydraulic cylinder in the knockout process.

According to the die cushion device, the hydraulic oil is filled in a pressurized manner in the hydraulic closed circuit, and a hydraulic pump for pressurizing and supplying the hydraulic oil in one cycle period of the cushion pad, is not provided. Therefore, it is possible to make the die cushion device simple and inexpensive, and to save the power cost required for the die cushion process.

CITATION LIST

Patent Literature

Patent Document 1: Japanese Patent Application Laid-Open No. 2016-407

SUMMARY OF THE INVENTION

In the die cushion device described in Patent Document 1, as illustrated in FIG. 8, when a slide reaches a bottom dead center, the cushion pad is locked for a predetermined period at the bottom dead center. When the slide begins to rise (move upward) from the bottom dead center, the system pressure (around 40 kg/cm$^2$) applied to the die cushion pressure generation chamber of the hydraulic cylinder is released (the compressed volume of hydraulic oil is released) (Arrow A in FIG. 8) and the cushion pad rises slightly (around 2 mm).

After the cushion pad slightly rises, since the hydraulic oil supplied to the die cushion pressure generation chamber of the hydraulic cylinder is shut off, the cushion pad is locked in the vicinity of the bottom dead center.

As described above, in the die cushion device described in Patent Document 1, because the cushion pad rises by around 2 mm from a position of the bottom dead center when the system pressure is released, there is a concern that troubles such as scratches and cracks might occur in a molded product when a thin plate is drawn.

The present invention has been made in view of the above circumstances, and aims to provide a die cushion device that does not require equipment such as a hydraulic pump that consumes electric power, is inexpensive and functionally efficient, and is capable of complete locking (below the slide bottom dead center).

In order to achieve the object above, a die cushion device according to one aspect of the present invention includes: a cushion pad; a fluid-pressure cylinder configured to move the cushion pad up and down; and a fluid-pressure closed circuit. The fluid-pressure closed circuit including: a die cushion pressure generation line connected to a die cushion pressure generation chamber of the fluid-pressure cylinder; a first system pressure line connected to a first accumulator which is configured to accumulate hydraulic fluid having first system pressure capable of lowering process of the fluid-pressure cylinder; a lowering pressure generation line connected to the cushion pad lowering pressure generation chamber of the fluid-pressure cylinder; a second system pressure line connected to a second accumulator which is configured to accumulate hydraulic fluid having second system pressure lower than the first system pressure, the second system pressure line capable of knockout process; a pilot drive type logic valve provided between the die cushion pressure generation line and the first system pressure line, and operable as a main relief valve when die cushion process is performed; and a pilot relief valve provided between the die cushion pressure generation line and the first system pressure line, and configured to generate pilot pressure for controlling the logic valve. In the fluid-pressure closed circuit, hydraulic fluid is filled in a pressurized manner, the fluid-pressure closed circuit does not include a fluid-pressure pump configured to pressurize and feed the hydraulic fluid. In the first system pressure line and the second system pressure line in the fluid-pressure closed circuit, the hydraulic fluid can be pressurized by using only die cushion force applied from the cushion pad through the fluid-pressure cylinder, in one cycle period of the cushion pad, including the die cushion process and the knockout process.

According to the one aspect of the present invention, in addition to the die cushion pressure generation line and the first system pressure line, the fluid-pressure closed circuit is provided with a cushion pad lowering pressure generation line and a second system pressure line. During locking at the bottom dead center of the cushion pad, the cushion pad lowering pressure generation chamber of the fluid-pressure cylinder can be connected to the first system pressure line via the cushion pad lowering pressure generation line, and the die cushion pressure generation chamber of the fluid-pressure cylinder can be connected to the second system pressure line via the die cushion pressure generation line. As a result, even if the slide begins to move upward from the bottom dead center, the fluid-pressure cylinder enables the lowering process of the cushion pad by differential pressure between the first system pressure and the second system pressure. Thereby, it is possible to prevent a slight rise of the cushion pad during locking, that is, it is possible to hold the cushion pad below the slide bottom dead center.

In addition, in the fluid-pressure closed circuit combining the logic valve and the pilot relief valve, hydraulic fluid is filled in a pressurized manner. The hydraulic fluid in the fluid-pressure closed circuit is pressurized only by die cushion force applied from the cushion pad via the fluid-pressure cylinder during one cycle period of the cushion pad including the die cushion process and the knockout process. The fluid-pressure pump is not provided. During the die cushion process, the logic valve operates as a main relief valve and generates die cushion pressure according to the pilot pressure generated by the pilot relief valve. Also, raising process of the cushion pad after the locking for a predetermined period (or fixed period) is performed by hydraulic fluid of second system pressure accumulated in the second accumulator. In this manner, during one cycle period of the cushion pad, the hydraulic fluid is pressurized only by the die cushion force applied from the cushion pad via the fluid-pressure cylinder. Because the fluid-pressure closed circuit is not provided with a fluid-pressure pump, the power cost can be saved.

In a die cushion device according to another aspect of the present invention, it is preferable to provide a first solenoid valve configured to switch pressure acting on a pilot port of the logic valve, to any one of the pilot pressure and the first system pressure during one cycle period of the cushion pad. When the first solenoid valve switches such that the pilot pressure acts on the pilot port of the logic valve, it is possible to generate die cushion pressure corresponding to the pilot pressure in the die cushion pressure generation line. In addition, when the first solenoid valve switches such that first system pressure acts on the pilot port of the logic valve, it is possible to release die cushion pressure generated in the die cushion pressure generation line.

In a die cushion device according to yet another aspect of the present invention, it is preferable that the first solenoid valve is a poppet type solenoid valve. This is because there is no leak of hydraulic fluid in the poppet type solenoid valve.

In a die cushion device according to yet another aspect of the present invention, it is preferable to provide a second solenoid valve that enables opening and closing between the die cushion pressure generation line and the second system pressure line. The second solenoid valve is controlled to enable the raising process of the cushion pad.

In a die cushion device according to yet another aspect of the present invention, it is preferable that the second solenoid valve is the poppet type solenoid valve. This is because there is no leak of hydraulic fluid in the poppet type solenoid valve.

In a die cushion device according to yet another aspect of the present invention, it is preferable to provide a third solenoid valve that enables opening and closing between the lowering pressure generation line and the first system pressure line, and a fourth solenoid valve that enables opening and closing between the lowering pressure crating line and the second system pressure line. The third solenoid valve is controlled to enable the lowering process of the fluid-pressure cylinder during the locking at the bottom dead center and to hold the cushion pad at the bottom dead center or below the bottom dead center.

In a die cushion device according to yet another aspect of the present invention, it is preferable that the third solenoid valve and the fourth solenoid valve are the poppet type solenoid valves. This is because there is no leak of hydraulic fluid in the poppet type solenoid valve.

In a die cushion device according to yet another aspect of the present invention, it is preferable that there is provided a controller configured to control the first solenoid valve and the second solenoid valve, and that the controller controls the first solenoid valve such that the pilot pressure is applied to the pilot port of the logic valve during the lowering period of the cushion pad, and controls the second solenoid valve during the raising period of the cushion pad.

In a die cushion device according to yet another aspect of the present invention, the first solenoid valve is controlled by the controller so as to apply the pilot pressure to the pilot port of the logic valve during the lowering period of the cushion pad to enable die cushion pressure corresponding to the pilot pressure to be generated in the die cushion pressure generation line, as well as to enable die cushion force to be generated in the fluid-pressure cylinder during the lowering period of the cushion pad. In addition, by closing the second solenoid valve, the supply of the hydraulic fluid of second system pressure to the die cushion pressure generation chamber of the fluid-pressure cylinder is shut off to enable the cushion pad to be locked. In this case, since the cushion pad is locked by preventing the hydraulic fluid of second system pressure from being supplied to the die cushion pressure generation chamber of the fluid-pressure cylinder, the cushion pad is moved upward slightly from the bottom dead center (no complete locking is done). However, it is applicable to a case where locking does not affect the press forming even when the cushion pad slightly moves upward. Further, during raising process of the cushion pad after locking for a predetermined period, the second solenoid valves are opened to enable the hydraulic fluid of second system pressure to be supplied to the die cushion pressure generation chamber and the cushion pad lowering pressure generation chamber of the fluid-pressure cylinder, respectively. An upward force acts on the fluid-pressure cylinder according to the difference in pressurized area (or pressure receiving area) between the die cushion pressure generation chamber and the cushion pad lowering pressure generation chamber, and the hydraulic fluid of second system pressure is supplied to the die cushion pressure generation chamber of the fluid-pressure cylinder, thereby enabling to raise (move upward) the cushion pad. In addition, since this controller performs only simple control of the first and second solenoid valves (because a special control device is unnecessary), a part of the press machine controller (PLC: programmable logic controller) and the like can be diverted and the device is inexpensive.

In a die cushion device according to yet another aspect of the present invention, it is preferable to include a controller configured to control the first solenoid valve, the second solenoid valve, the third solenoid valve and the fourth solenoid valve, wherein the controller controls the first solenoid valve such that the pilot pressure is applied to the pilot port of the logic valve during lowering period of the cushion pad, generates a die cushion force on the cushion pad by the fluid-pressure cylinder, controls the first solenoid valve, the second solenoid valve, the third solenoid valve and the fourth solenoid valve such that the cushion pad stops at or below a bottom dead center between the lowering period of the cushion pad and raising period of the cushion pad, and controls the second solenoid valve during the raising period of the cushion pad.

According to yet another aspect of the present invention, die cushion pressure corresponding to the pilot pressure is generated in the die cushion pressure generation line by controlling the first solenoid valve by the controller such that the pilot pressure is applied to the pilot port of the logic valve during the lowering period of the cushion pad and die cushion force can be generated in the fluid-pressure cylinder during the lowering period of the cushion pad. Further, during locking of the cushion pad at the bottom dead center, by opening the second solenoid valve and the third solenoid valve and closing the fourth solenoid valve, the first system pressure is applied to the cushion pad lowering pressure generation chamber of the fluid-pressure cylinder and the second system pressure is applied to the die cushion pressure generation chamber of the fluid-pressure cylinder. Thereby, even when the slide begins to move upward from the bottom dead center, downward pressing force can be applied to the fluid-pressure cylinder by differential pressure between first system pressure and second system pressure. Thus, it is possible to prevent the slight rise of the cushion pad during the locking, that is, to hold the cushion pad at or below the slide bottom dead center. Further, during the raising process of the cushion pad after locking for a predetermined period, the second solenoid valves are opened to enable the hydraulic fluid of second system pressure to be supplied to the die cushion pressure generation chamber and the cushion pad lowering pressure generation chamber of the fluid-pressure cylinder, respectively. An upward pressing force acts on the fluid-pressure cylinder according to the difference in pressurized area between the die cushion pressure generation chamber and the cushion pad lowering pressure generation chamber, and the hydraulic fluid having the second system pressure is supplied to the die cushion pressure generation chamber of the fluid-pressure cylinder, thereby enabling to raise (move upward) the cushion pad. In addition, since this controller performs only simple control of the first, second, third, and fourth solenoid valves, a part (PLC) of the controller of the press machine and the like can be diverted, and the device is inexpensive.

In a die cushion device according to yet another aspect of the present invention, it is preferable that a plurality of the second solenoid valves are provided in parallel between the die cushion pressure generation line and second system pressure line, and the controller individually controls opening and closing of the plurality of second solenoid valves during the raising period of the cushion pad to control a rising speed of the cushion pad. That is, by changing the number of the second solenoid valves to be opened and closed, a flow rate of hydraulic fluid supplied from the second accumulator to the die cushion pressure generation line can be changed gradually, as a result, the rising speed of the cushion pad can be controlled.

In a die cushion device according to yet another aspect of the present invention, it is preferable to dispose a throttle valve, or a throttle valve and a coupler for fluid feeding and system pressure sealing in the die cushion pressure generation line, the first system pressure line, the second system pressure line, and a pilot pressure generation line having the pilot relief valve. This is because when hydraulic fluid is filled in the fluid-pressure closed circuit in a pressurized manner by an external feeding fluid device, the valve or the valve and the coupler serve as a filler port and an exhaust port for the hydraulic fluid.

In a die cushion device according to yet another aspect of the present invention, it is preferable to include a feeding fluid device which includes: a tank configured to store the hydraulic fluid; a discharge port for feeding the hydraulic fluid into the fluid-pressure closed circuit; a return port for receiving the hydraulic fluid returned from the fluid-pressure closed circuit, the return port being connected to the tank; and a fluid-pressure pump configured to supply the hydraulic fluid from the tank to the fluid-pressure closed circuit through the discharge port. In the feeding fluid device, the fluid-pressure pump is driven only when the hydraulic fluid is filled in the fluid-pressure closed circuit in a pressurized manner. The feeding fluid device above is an external device that is attached to and detached from the die cushion device, and that is connected to be used only when the hydraulic fluid is filled in the fluid-pressure closed circuit in a pressurized manner. The feeding fluid device is not required to be accompanied for each of die cushion devices, but one feeding fluid device can be used for a plurality of controlled die cushion devices.

In a die cushion device according to yet another aspect of the present invention, it is preferable to accompany the feeding fluid device with an extension hose that is to be connected to at least one of the discharge port and the return port, and preferable that a coupler is provided at each of both ends of the extension hose. As a result, if the discharge port and the return port of the feeding fluid device cannot be directly connected to the fluid-pressure closed circuit, it is possible to be connected to the fluid-pressure closed circuit through the extension hose.

According to yet another aspect of the present invention, the first solenoid valve is controlled so as to apply the pilot pressure to the pilot port of the logic valve during the lowering (moving down) period of the cushion pad to enable die cushion pressure corresponding to the pilot pressure to be generated in the die cushion pressure generation line, as well as to enable die cushion force to be generated in the fluid-pressure cylinder during the lowering period of the cushion pad. In addition, the second solenoid valve is opened at an appropriate timing after the die cushion process to enable hydraulic fluid at system pressure accumulated in the accumulator to be supplied to the fluid-pressure cylinder through the die cushion pressure generation line. As a result, it is possible to raise the cushion pad to a standby position.

According to the present invention, in one process cycle (die cushion lowering process, locking process, raising process), a fluid-pressure pump or an air pressure source or the like that consumes electric power is unnecessary, and locking can be perfectly performed (at or below the slide bottom dead center) when the cushion pad is locked by an inexpensive and functional device without using a special (dedicated) controller.

DETAILED DESCRIPTION OF THE EMBODIMENTS

With reference to accompanying drawings, preferred embodiments of a die cushion device according to the present invention will be described in detail.

<Configuration of Die Cushion Device>

Figure 1:
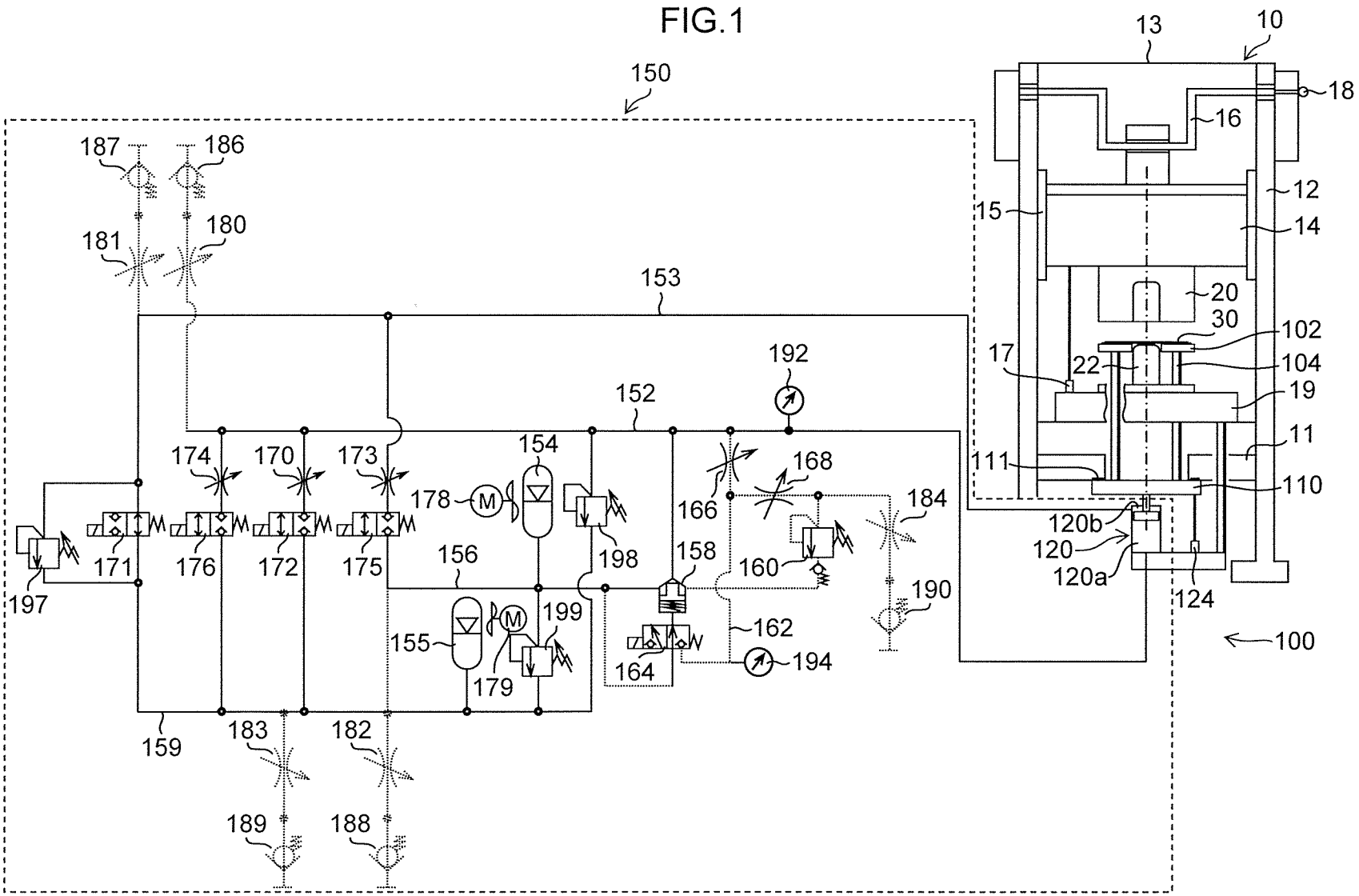
FIG. 1 is a configuration diagram illustrating an embodiment of a die cushion device according to the present invention when applied to a press machine.

FIG. 1 is a configuration diagram illustrating an embodiment of a die cushion device according to the present invention when applied to a press machine.

In the press machine 10 illustrated in FIG. 1, a frame is composed of a bed 11, a column 12 and a crown 13, and a slide 14 is movably guided in a vertical direction by a guide section 15 provided in the column 12. The slide 14 is moved in the vertical direction in FIG. 1 by a servo motor (not illustrated), or a crank mechanism including a crankshaft 16 to which rotational driving force is transmitted by a flywheel (not illustrated).

It is preferable that the press machine 10 is provided, on its bed 11 side, with a slide position detector 17 that detects a position of the slide 14, or that the crankshaft 16 is provided with a crankshaft encoder 18 that detects an angle of the crankshaft 16.

An upper die 20 is mounted on the slide 14, and a lower die 22 is mounted on a bolster 19 on the bed 11.

A blank holder (blank holding plate) 102 is disposed between the upper die 20 and the lower die 22 such that a lower side of the blank holder is supported by a cushion pad 110 through a plurality of cushion pins 104 and a material 30 is set on (brought into contact with) an upper side of the blank holder.

<Structure of the Die Cushion Device>

A die cushion device 100 includes: the blank holder 102; the cushion pad 110 that supports the blank holder 102 through the plurality of cushion pins 104; a hydraulic cylinder (fluid-pressure cylinder) 120 that supports the cushion pad 110 and generates die cushion force for the cushion pad 110; and a hydraulic closed circuit (fluid-pressure closed circuit) 150 that is connected to a die cushion pressure generation chamber 120*a* and a cushion pad lowering pressure generation chamber (pressure generation chamber for lowering the cushion pad) 120*b* of the hydraulic cylinder 120.

The hydraulic cylinder 120 and the hydraulic closed circuit 150 serve as a cushion pad lifting unit that moves (lifts) the cushion pad 110 up and down. Further, the hydraulic cylinder 120 and the hydraulic closed circuit 150 serve as a die cushion force generation unit that generates die cushion force for the cushion pad 110.

In addition, the hydraulic cylinder 120 is provided with a die cushion position detector 124 that detects a position of a piston rod of the hydraulic cylinder 120 in an expanding direction (expanding/contracting direction) thereof as a position of the cushion pad 110 in an up-and-down direction thereof. The die cushion position detector 124 may be provided between the bed 11 and the cushion pad 110.

Next, a configuration of the hydraulic closed circuit 150 that drives the hydraulic cylinder 120 will be described.

The hydraulic closed circuit 150 includes: a die cushion pressure generation line 152 that is connected to the die cushion pressure generation chamber 120*a* of the hydraulic cylinder 120; a first system pressure line 156 which is connected to a first accumulator 154 that accumulates hydraulic oil (hydraulic fluid) having first system pressure capable of moving the hydraulic cylinder 120 downward; a lowering pressure generation line 153 that is connected to the cushion pad lowering pressure generation chamber 120*b* of the hydraulic cylinder 120; a second system pressure line 159 which is connected to a second accumulator 155 that accumulates hydraulic oil having second system pressure lower than the first system pressure, and that is capable of knockout process; a pilot drive type logic valve 158 that is disposed between the die cushion pressure generation line 152 and the first system pressure line 156, and that is operable as a main relief valve at the time of die cushion process; and a pilot relief valve 160 that is disposed between the die cushion pressure generation line 152 and the first system pressure line 156, and that generates pilot pressure for controlling the logic valve 158. Here, it is preferable that the logic valve 158 and the pilot relief valve 160 are a direct acting type in which there is little leak (no leak).

The first accumulator 154 is filled with a gas having a pressure of about 40 kg/cm$^2$ to 120 kg/cm$^2$. The first system pressure line 156 to which the first accumulator 154 is connected, is filled with hydraulic oil having an approximately constant pressure (the first system pressure) of about 60 kg/cm$^2$ to 140 kg/cm$^2$ in advance (before machine operation). The pressure of the hydraulic oil is higher than the pressure of the second system pressure line 159.

The first system pressure line 156 including the first accumulator 154 plays a role of a power source that mainly lowers the hydraulic cylinder 120. The first system pressure line 156 also plays a role of a preliminary pressure source having a preliminary pressure that accelerates the response of the die cushion pressure, and a role of a compensating element by a boosting action, that cancels out an override characteristic (as the position approaches the bottom dead center, the slide speed decreases and the pressure decreases) of the die cushion pressure by the logic valve 158 that functions as the main relief valve. Therefore, it is preferable that the first accumulator 154 has an appropriate volume (capacity) such that an increment of first system pressure caused by accumulating the hydraulic oil during the die cushion action cancels the override characteristic of the die cushion pressure by the logic valve 158.

The second accumulator 155 is filled with a hydraulic oil having a pressure lower than the gas pressure of the first accumulator 154 by about 20 kg/cm$^2$ to 50 kg/cm$^2$. The second system pressure line 159 to which the second accumulator 155 is connected, is filled with a hydraulic oil having an approximately constant pressure (the second system pressure) lower than the first system pressure by about 20 kg/cm$^2$ to 50 kg/cm$^2$, in advance (before machine operation). The second system pressure line 159 including the second accumulator 155 mainly plays a role of a power source for knocking out (raising) the hydraulic cylinder 120, and a role of a tank.

In addition, the hydraulic closed circuit 150 includes a first solenoid valve 164 that switches pressure to act on a pilot port of the logic valve 158, to any one of the pilot pressure generated in the pilot pressure generation line 162 and the first system pressure generated in the first system pressure line 156. It is preferable that the first solenoid valve 164 is a poppet type solenoid valve with a slight leak (non-leak) at a closed port. Further, the pilot pressure generation line 162 is provided with throttle valves (variable throttle valves) 166, 168, and the flow rate is regulated here. In this example, the throttle valve 168 is fully opened.

Further, between the die cushion pressure generation line 152 and the second system pressure line 159, a throttle valve 170 and a second solenoid valve 172 are disposed in parallel, similarly, a throttle valve 174 and a second solenoid valve 176 are disposed in parallel. The second solenoid valves 172 and 176 are ON/OFF controlled, respectively. The second solenoid valves 172 and 176 are solenoid valves that enable opening and closing between the die cushion pressure generation line 152 and the second system pressure line 159. It is preferable that the second solenoid valves 172 and 176 are poppet type solenoid valves with little leakage when fully closed.

Further, between the lowering pressure generation line 153 and the first system pressure line 156, a throttle valve 173 and a third solenoid valve 175 are disposed. Between the lowering pressure generation line 153 and the second system pressure line 159, a fourth solenoid valve 171 is disposed. The third solenoid valve 175 and the fourth solenoid valve 171 are ON/OFF controlled, respectively. The third solenoid valve 175 and the fourth solenoid valve 171 are solenoid valves that enable opening and closing between the lowering pressure generation line 153 and the first system pressure line 156, and between the lowering pressure generation line 153 and the second system pressure line 159, respectively. It is preferable that the third solenoid valve 175 and the fourth solenoid valve 171 are poppet type solenoid valves with little leakage when fully closed.

The first accumulator 154 and the second accumulator 155 are provided with cooling devices 178 and 179 such that hydraulic oil can be cooled via the first accumulator 154 and the second accumulator 155 by the cooling devices 178 and 179. Though these cooling devices 178 and 179 are air cooling type cooling devices using fans, the type of the cooling devices is not limited to this. The cooling devices 178 or 179 may be a water cooling type cooling device that cools hydraulic oil by circulating cooling water. When the use frequency of the die cushion device 100 is low, it is possible to cope with only natural heat radiation without providing a cooling device, and a more inexpensive device can be implemented.

In addition, the die cushion pressure generation line 152, the lowering pressure generation line 153, the first system pressure line 156, the second system pressure line 159 and the pilot pressure generation line 162 are respectively provided with throttle valves (needle valves) 180, 181, 182, 183, 184 and couplers 186, 187, 188, 189, 190, for fluid feeding and system pressure sealing.

Further, a pressure detector 192 for detecting the die cushion pressure and a pressure detector 194 for detecting the pilot pressure are provided on the die cushion pressure generation line 152 and the pilot pressure generation line 162, respectively.

In FIG. 1, reference numerals 197, 198, and 199 indicate relief valves functioning as safety valves.

<Oil Supply Device (Feeding Fluid Device)>

Next, an oil supply device will be described.

Figure 2:
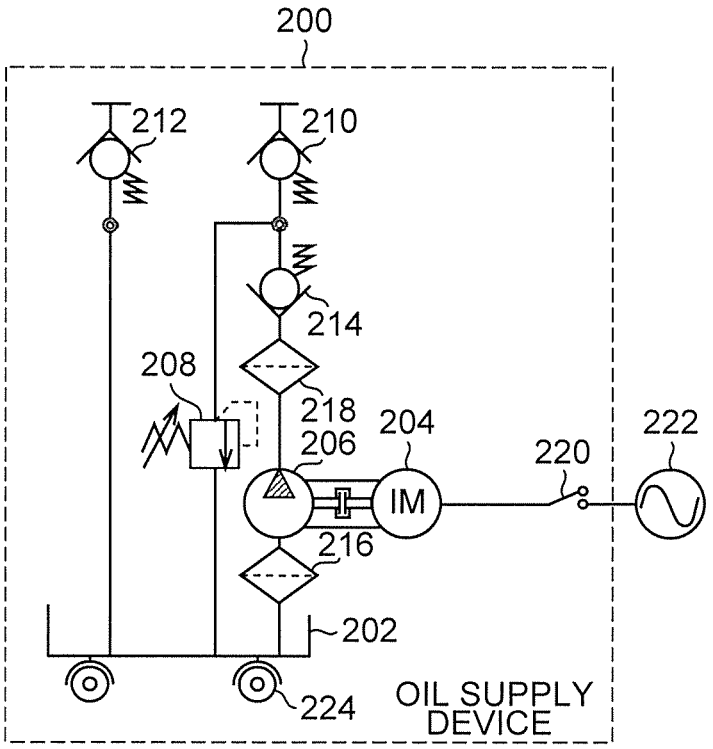
FIG. 2 is a configuration diagram illustrating an embodiment of an oil supply device.

FIG. 2 is a configuration diagram illustrating an embodiment of the oil supply device.

The oil supply device 200 is used when oil is supplied and the system pressure is filled, or when the system pressure is released (at the time of setup preparation), but is not used when the die cushion device 100 performs its cyclic function (normal function).

Thus, the oil supply device 200 is not required to be accompanied for each of die cushion devices 100. It is sufficient to prepare one fluid supply device for a plurality of die cushion devices 100 to be managed.

As illustrated in FIG. 2, the oil supply device 200 includes: a tank 202 that stores hydraulic oil; a hydraulic pump (fluid-pressure pump) 206 that is driven by an induction motor 204; a relief valve 208 that serves as a safety valve; couplers 210 and 212; a check valve 214; and filters 216 and 218.

The two couplers 210 and 212 of the oil supply device 200 are connected to any two of the five respective couplers 186, 187, 188, 189, and 190, provided in the die cushion pressure generation line 152, the lowering pressure generation line 153, the first system pressure line 156, the second system pressure line 159, and the pilot pressure generation line 162, in the hydraulic closed circuit 150, respectively.

Figure 3:
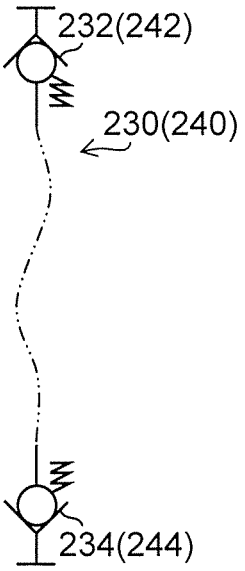
FIG. 3 illustrates an extension hose that connects a hydraulic closed circuit and the oil supply device.

In a case where the couplers 210 and 212 of the oil supply device 200 cannot be connected to any two of the five respective couplers 186, 187, 188, 189, and 190, of the hydraulic closed circuit 150, the couplers 210 and 212 are connected to any two of them through one extension hose 230 or two extension hoses 230 and 240 illustrated in FIG. 3.

The extension hose 230 (240) is provided at its both ends with respective couplers 232 (242) and 234 (244) such that the coupler 210 or 212 on the oil supply device side and the coupler 186, 187, 188, 189, or 190 on hydraulic closed circuit side can be connected through the couplers.

When a switch 220 is turned ON, the induction motor 204 of the oil supply device 200 is driven by AC current (alternating-current) from an AC (alternating-current) power source 222 to operate the hydraulic pump 206. Accordingly, it is possible to supply the hydraulic oil in the tank 202 to the hydraulic closed circuit 150 of the die cushion device 100 through the filters 216 and 218, the check valve 214, and the coupler 210 (or the coupler 210 and the extension hose 230). In addition, it is possible to return the hydraulic oil to the tank 202 from the hydraulic closed circuit 150 through the coupler 212 (or the coupler 212 and the extension hose 240).

Further, the oil supply device 200 is provided, in its lower surface, with casters 224 so as to make the oil supply device 200 easily movable.

<Flushing/Oil Supply/Pressure Releasing>

When the die cushion device 100 of the present embodiment is used, it is required to perform preparation and setup operation for filling hydraulic oil into the hydraulic closed circuit 150 in a pressurized manner.

Figure 4:
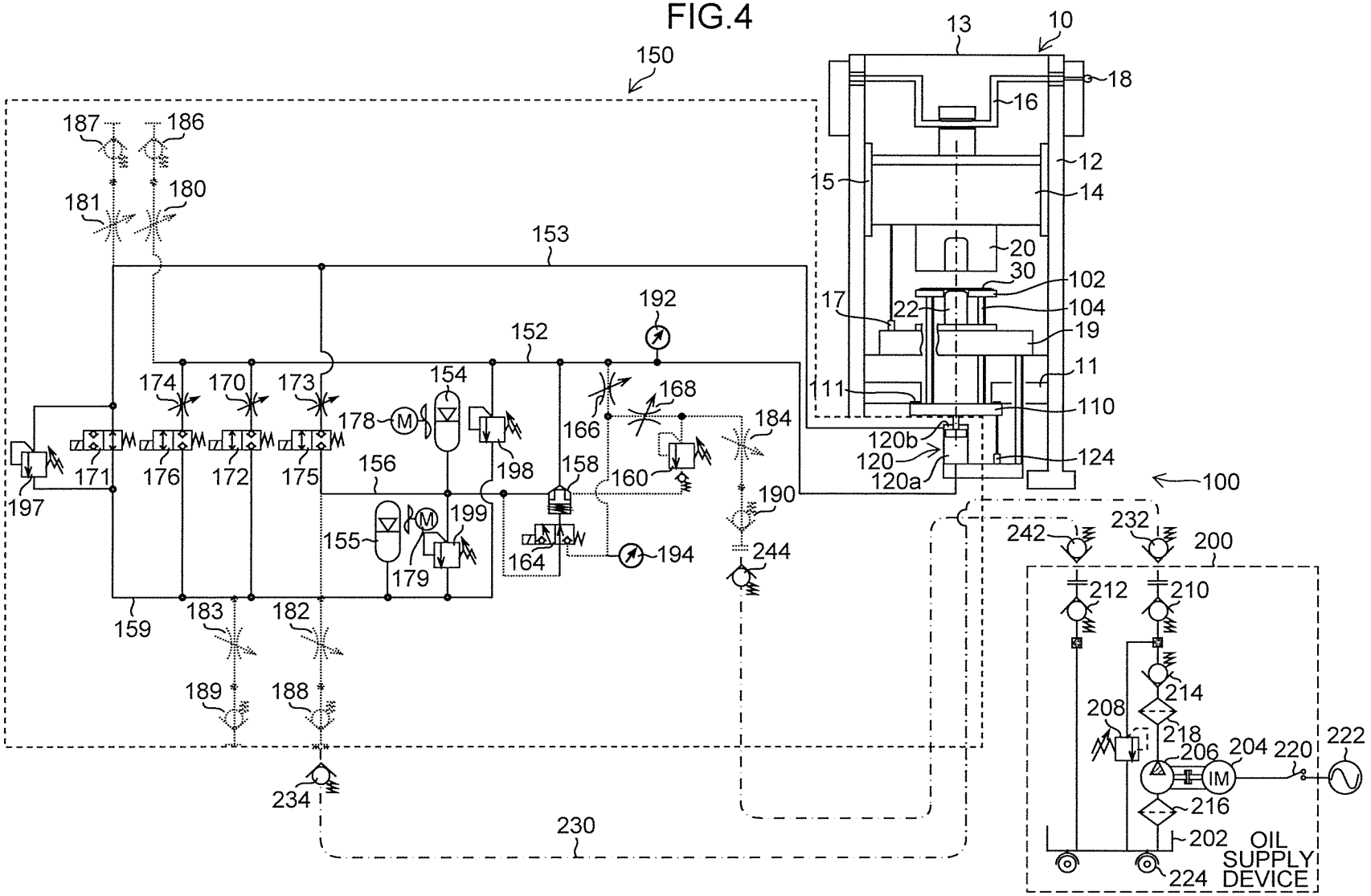
FIG. 4 illustrates a state where the hydraulic closed circuit and the oil supply device are connected through the extension hose.

With reference to FIG. 4, an example of the preparation and setup operation will be specifically described.

First, the coupler 210 at the discharge port of the oil supply device 200 (or the coupler 234 at one end of the extension hose 230 in which the coupler 232 at the other end is connected to the coupler 210), the coupler 212 at the return port of the oil supply device 200 (or the coupler 244 at one end of the extension hose 240 in which the coupler 242 at the other end is connected to the coupler 212), and any two couplers out of the five couplers 186, 187, 188, 189, and 190 of the hydraulic closed circuit 150 are connected. Then, the hydraulic closed circuit 150 circulates the hydraulic oil to perform a flushing operation for contamination removal and air bleeding inside the hydraulic closed circuit 150. The throttle on the flow path inside the hydraulic closed circuit 150 through which the hydraulic oil circulates is fully opened, the relief valve is set at the lowest pressure, and the solenoid valve is turned ON at the proper place at the appropriate time. Connection points between the coupler 210 at the discharge port of the oil supply device 200 (or the coupler 234 at the one end of the extension hose 230), the coupler 212 at the return port of the oil supply device 200 (or the coupler 244 at the one end of the extension hose 240), and any two couplers of the five couplers 186, 187, 188, 189, and 190 of the hydraulic closed circuit 150 are changed in several ways.

For example, in FIG. 4, when flushing inside the hydraulic closed circuit 150, particularly between the first system pressure line 156 and the pilot pressure generation line 162, the coupler 210 at the discharge port on the discharge side of the oil supply device 200 (or the coupler 234 at the one end of the extension hose 230) and the coupler 188 of the first system pressure line 156 are connected, and the coupler 212 at the return port of the hydraulic closed circuit 150 (or the coupler 244 at the one end of the extension hose 240) and the coupler 190 of the pilot pressure generation line 162 are connected. Then, all the throttle valves 182, 166, 168, 184 therebetween are fully opened, and the first solenoid valve 164 is turned ON such that the hydraulic oil flows through the poppet portion of the logic valve 158.

When the flushing is completed, contaminants are removed inside the hydraulic closed circuit 150, and hydraulic oil at atmospheric pressure is filled. The flushing operation may be performed only once (at the time of starting up the device) after the device is manufactured.

Next, the hydraulic closed circuit 150 is supplied with oil. Basically, as for the oil supply method (path), one manner (one pattern) is determined for each device (for each closed circuit). In the case of FIG. 4, the coupler 210 of the discharge port on the discharge side of the oil supply device 200 (or the coupler 234 at the one end of the extension hose 230) is connected to the coupler 188 of the first system pressure line 156 (which accumulates hydraulic oil having the highest pressure in the closed circuit). The relief valves 198 and 199 are set to predetermined values (in this example, the relief valve 198 is set to 300 kg/cm$^2$ as a safety valve and the relief valve 199 is set to 120 kg/cm$^2$), and the second solenoid valve 172 is turned ON (all other solenoid valves are in the OFF state, the throttle valve 182 is fully opened, and the throttle valve in the hydraulic closed circuit 150 is set to a predetermined set value). In the present example, a setting relief pressure (pressure of the relief valve 208) on the pump discharge side of the oil supply device 200 is 120 kg/cm$^2$.

When the hydraulic pump 206 of the oil supply device 200 is turned ON in this state, first, while accumulating pressure in the first accumulator 154, the first system pressure line 156 is filled with hydraulic oil having a pressure of 120 kg/cm$^2$. While accumulating, via the relief valve 199, pressure in the second accumulator 155 that acts as the tank of the second system pressure line 159, the surplus hydraulic oil pressurizes the lowering pressure generation line 153 from the second system pressure line 159 via the fourth solenoid valve 171, and pressurizes the die cushion pressure generation line 152 via the second solenoid valve 172 in the ON state. At this point, the cushion pad 110 is raised to the upper limit position. Finally, when a pressure (pressure detector 192) of the die cushion pressure generation line 152 reaches 80 kg/cm$^2$, oil supply is completed.

In the normal state, the first system pressure line 156 and the die cushion pressure generation line 152 are shut off. In order to prevent hydraulic oil from leaking from the first system pressure line 156 to the second system pressure line 159 via the die cushion pressure generation line 152 and the second solenoid valve 172, when the first solenoid valve 164 is OFF, the first system pressure acts on the pilot port of the logic valve 158.

Oil supply is performed every time when a die is exchanged. Every time when a die is exchanged, the pressure of the main part filled in the hydraulic closed circuit 150 is released, the cushion pad 110 is lowered temporarily, and the die attaching and detaching work is performed, and then, oiling is performed before the next production operation using the newly mounted die.

Similarly, as for a pressure release method, basically, one manner (one pattern) is determined for each device (hydraulic closed circuit). In the case of FIG. 4, the coupler 212 at the return port of the oil supply device 200 (or the coupler 244 at the one end of the extension hose 240 in which the coupler 242 at the other end is connected to the coupler 212) is connected to the coupler 189 of the second system pressure line 159. The second solenoid valve 172 is turned ON in the same manner as in oil supply. When the throttle valve 183 is opened in this state, hydraulic oil which has filled the lowering pressure generation line 153, the die cushion pressure generation line 152, and the second system pressure line 159 is discharged to the tank 202 of the oil supply device 200, and pressure of the lines is released. When the pressure of the die cushion pressure generation line 152 (pressure detector 192) has decreased to the atmospheric pressure, the pressure release is completed. At this point, the cushion pad 110 is lowered down to the lower limit position. At this time, hydraulic oil in the first system pressure line 156 remains with a predetermined pressure value. As a result, time needed for the next oil supply can be shortened.

Oil supply and pressure releasing can be automated when they are performed frequently for each die change operation.

Figure 5:
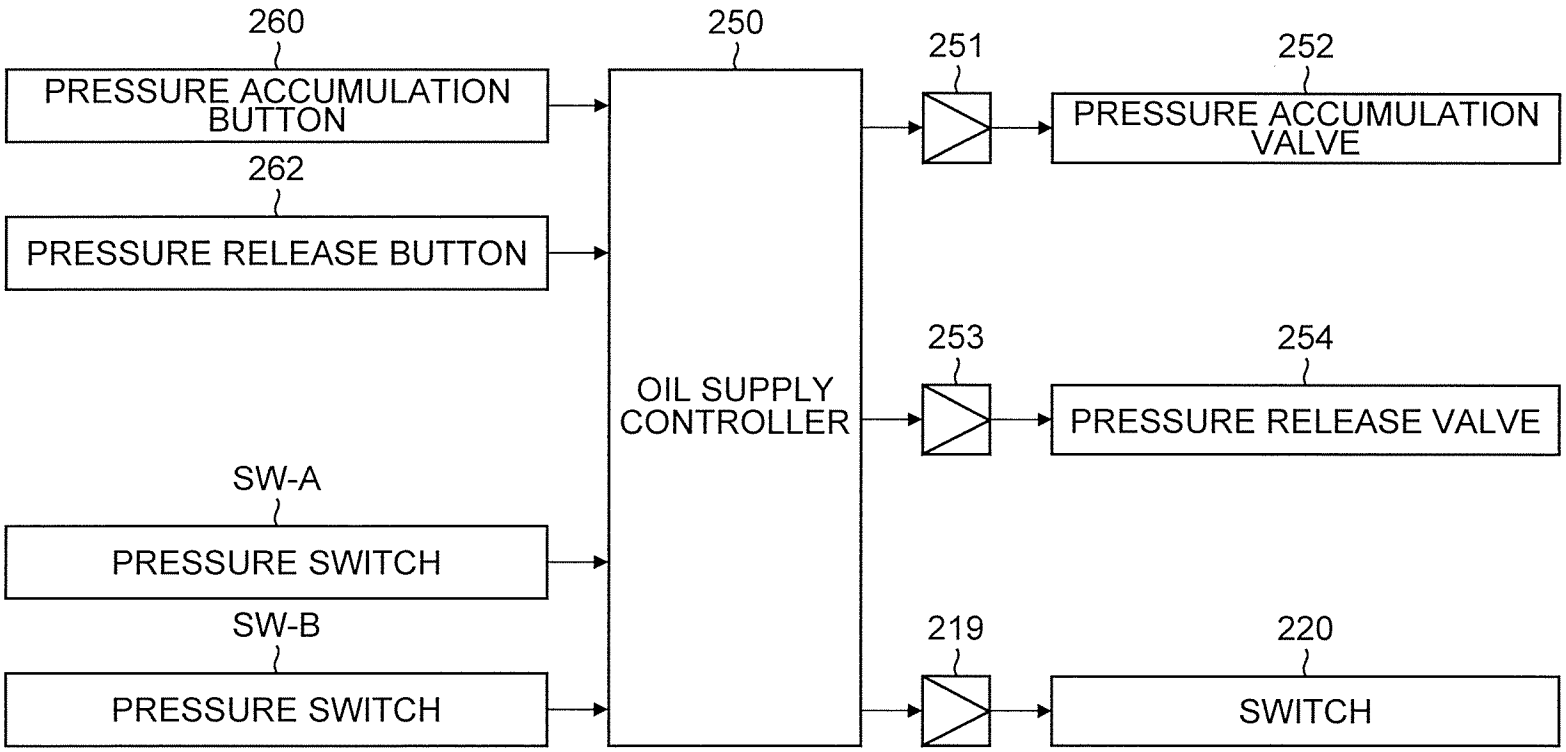
FIG. 5 is a block diagram illustrating an embodiment of an automatic control unit of the oil supply device when oil supply and pressure release are performed automatically.

As one example, the coupler 210 at the discharge port of the oil supply device 200 (or the coupler 234 at the one end of the extension hose 230 in which the coupler 232 at the other end is connected to the coupler 210) and the coupler 188 at the first system pressure line 156 are always connected to each other, the coupler 212 at the return port of the oil supply device 200 (or the coupler 244 at the one end of the extension hose 240 in which the coupler 242 at the other end is connected to the coupler 212) and the coupler 189 at the second system pressure line 159 are always connected to each other, and the throttle valve 182 and the throttle valve 183 are replaced with a pressure accumulation valve 252 and a pressure release valve 254 that are configured by poppet (non-leak) type solenoid valves respectively (see FIG. 5).

FIG. 5 is a block diagram illustrating an embodiment of an automatic control unit of the oil supply device 200 when oil supply and pressure release are performed automatically.

The automatic control unit of the oil supply device 200 illustrated in FIG. 5 includes: the pressure accumulation valve 252 and the pressure release valve 254 replacing the throttle valves 182 and 183 as described above; a pressure accumulation button 260 and a pressure release button 262 that are push button switches for selecting between pressure accumulation and pressure release; a pressure switch SW-A that is turned ON in the vicinity of the atmospheric pressure and a pressure switch SW-B which is turned ON in the vicinity of 80 kg/cm$^2$, that are disposed in the die cushion pressure generation line 152; an oil supply controller 250; and relays 251, 253, and 219 that respectively drive the pressure accumulation valve 252, the pressure release valve 254, and the switch 220 (the switch that operates the induction motor 204).

Then, when the pressure accumulation button 260 is depressed in the pressure released state, the oil supply controller 250 turns ON the pressure accumulation valve 252 via the relay 251 and turns ON switch 220 via the relay 219, until the pressure switch SW-A is turned OFF and the pressure switch SW-B is turned ON (until the pressure accumulation is completed). As a result, the hydraulic pump 206 is driven (rotated) by the induction motor 204, and hydraulic oil is supplied from the oil supply device 200 to the hydraulic closed circuit 150.

When the pressure accumulation is completed (the pressure switch SW-A is turned OFF and the pressure switch SW-B is turned ON), the oil supply controller 250 turns OFF the pressure accumulation valve 252 and turns OFF the switch 220 to stop the hydraulic pump 206.

On the other hand, when the pressure release button 262 is depressed in the pressure accumulated state, the oil supply controller 250 turns ON the pressure release valve 254 via the relay 253 until the pressure switch SW-B is turned OFF and the pressure switch SW-A is turned ON (until the pressure release is completed), and the hydraulic oil is discharged. When the pressure release is completed (the pressure switch SW-B is turned OFF and the pressure switch SW-A is turned ON), the pressure release valve 254 is turned OFF.

<Controller>

Figure 6:
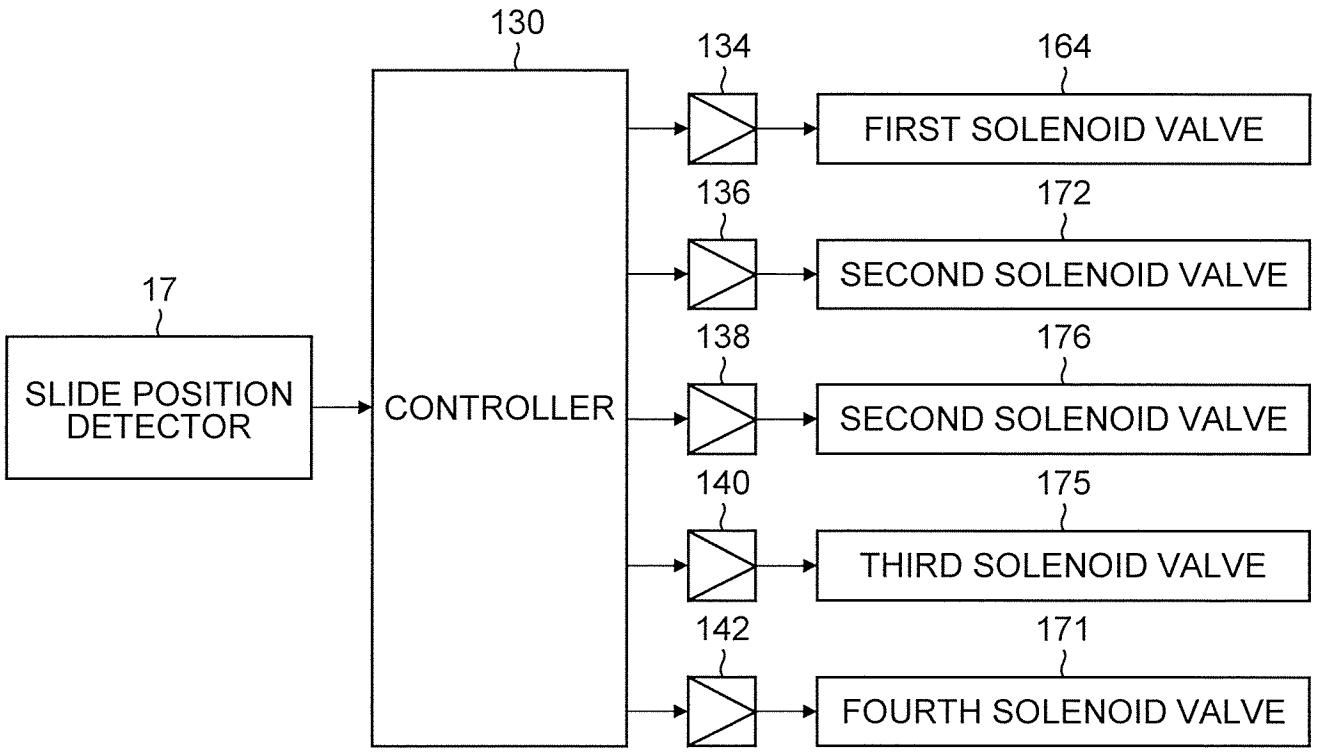
FIG. 6 is a block diagram illustrating an embodiment of a controller applied to the die cushion device.

FIG. 6 is a block diagram illustrating an embodiment of the controller 130 applied to the die cushion device 100.

The controller 130 illustrated in FIG. 6 controls ON/OFF of the first solenoid valve 164, the second solenoid valves 172, 176, the third solenoid valve 175, and the fourth solenoid valve 171 of the hydraulic closed circuit 150 illustrated in FIG. 1. The controller 130 controls ON/OFF of the relays 134, 136, 138, 140, or 142 according to the slide position detector 17, outputs a driving current to the first solenoid valve 164, the second solenoid valves 172, 176, the third solenoid valve 175, or the fourth solenoid valve 171 via relays 134, 136, 138, 140, or 142 that are ON/OFF controlled, and individually controls ON/OFF of the first solenoid valve 164, the second solenoid valves 172, 176, the third solenoid valve 175, or the fourth solenoid valve 171.

The controller 130 of the present embodiment provides a simple control for individually controlling ON/OFF of the first solenoid valve 164, the second solenoid valves 172, 176, the third solenoid valve 175, or the fourth solenoid valve 171 and the special control device is unnecessary. Therefore, a part (PLC) of the controller of the press machine 10 can be diverted, which does not lead to an increase in the cost of the die cushion device 100.

The ON/OFF control timing of the first solenoid valve 164, the second solenoid valves 172, 176, the third solenoid valve 175, or the fourth solenoid valve 171 by the controller 130 will be specifically described later. In addition, the controller 130 may control ON/OFF of the first solenoid valve 164, the second solenoid valves 172, 176, the third solenoid valve 175, or the fourth solenoid valve 171, according to the angle of the crankshaft 16 detected by the crankshaft encoder 18.

Figure 7:
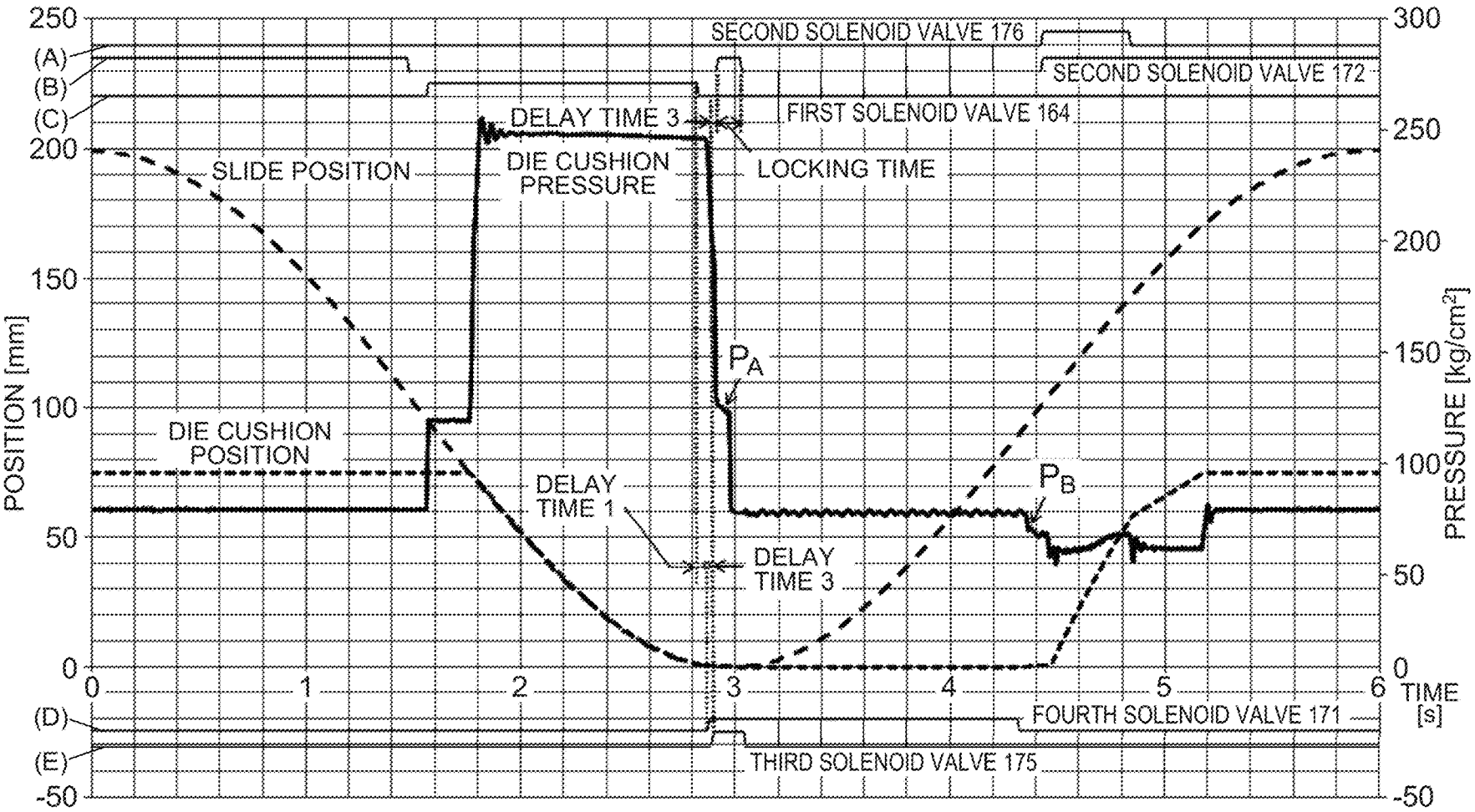
FIG. 7 is a waveform diagram illustrating a slide position of a slide, a position of a cushion pad (die cushion position) and a die cushion pressure, and a diagram illustrating an ON/OFF state of a first solenoid valve, a second solenoid valve, a third solenoid valve and a fourth solenoid valve in one cycle period.
Figure 8:
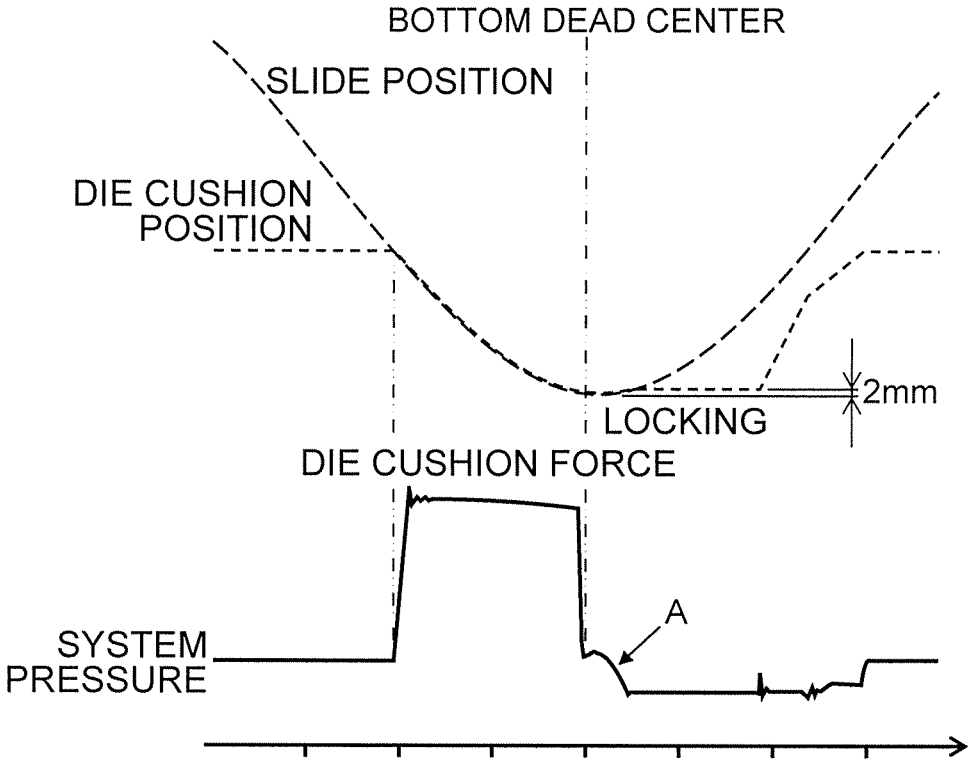
FIG. 8 is a waveform diagram illustrating a slide position, a die cushion position and a die cushion force in a conventional slide.

Hereinafter, one cycle process of the die cushion device 100 will be described with reference to waveform diagrams of each part of the die cushion device 100 shown in FIG. 7. In FIG. 7, the horizontal axis shows time (unit: second), the left vertical axis shows a die cushion position (unit: mm), and the right vertical axis shows a pressure (unit: kg/cm$^2$).

<Standby Process>

When at least the slide 14 is positioned at the top dead center, the controller 130 turns ON the second solenoid valve 172 (portion (B) in FIG. 7), and turns OFF the other solenoid valves (portions (A), (C) and (E) in FIG. 7) such that the die cushion pressure generation line 152 and the pressure of the second system pressure line 159 have the same pressure. Thereby, the second system pressure acts on the die cushion pressure generation chamber 120*a* and the cushion pad lowering pressure generation chamber 120*b* of the hydraulic cylinder 120, and the hydraulic cylinder 120 stops (stands by) at a rising limit (maximum height limit) (the cushion pad 110 abuts against the upper limit stopper 111 of the bed 11).

<Impact/Die Cushion Force Action Process>

The slide 14 of the press machine 10 begins to move downward, and before the slide 14 "impacts" the cushion pad 110 via the upper die 20, the material 30, the blank holder 102, and the cushion pin 104 (near the half stroke position (a crank angle of around 90 degrees) on the lowering side), the controller 130 turns OFF the second solenoid valve 172 (portion (B) in FIG. 7) and turns ON the first solenoid valve 164 (portion (C) in FIG. 7). As a result, the first system pressure of approximately 120 kg/cm$^2$ is applied to the die cushion pressure generation line 152.

In that state, when the slide 14 impacts the cushion pad 110, the die cushion pressure proportional to the die cushion force is generated in the die cushion pressure generation chamber 120*a* of the hydraulic cylinder 120 due to synergistic effect of the logic valve 158, the throttle valve 166 (throttle valve 168), and the pilot relief valve 160. That is, from the die cushion pressure generation line 152 till the first system pressure line 156, a hydraulic flow (a flow rate of hydraulic oil flowing per unit time) that is sourced from the die cushion pressure generation chamber 120*a* and driven via the throttle valve 166, the throttle valve 168 and the pilot relief valve 160, is generated. Along with the hydraulic flow, the pilot pressure lower than the die cushion pressure is generated between the throttle valve 166 and the throttle valve 168 (the pilot pressure generation line 162). As a result, the following pressures acts on the poppet of the logic valve 158 to keep balance of force: the die cushion pressure acting mainly on pressurized area on a die cushion pressure acting side; the first system pressure acting on pressurized area on a first system pressure acting side; the pilot pressure acting on pressurized area on a pilot pressure acting side (pressurized area on an X port side) through the first solenoid valve 164; a spring force acting on the poppet inside the logic valve; and a fluid force acting on the logic valve 158 in a direction interfering with (direction closing the valve) the flow of hydraulic oil from the die cushion pressure generation line 152 till the first system pressure line 156. Thus, a poppet position (opening degree) of the logic valve 158 is maintained according to a speed of the slide 14 (that is, the poppet position is almost constant if the speed is constant), and the die cushion pressure is generated during the above series of acts.

At this time, since the die cushion pressure is pressurized from an initial pressure of 120 kg/cm$^2$, it is possible to shorten the pressurizing time required to increase the die cushion pressure up to a set pressure of 250 kg/cm$^2$.

At this time, hydraulic oil flowing from the die cushion pressure generation line 152 to the first system pressure line 156 accumulates in the first accumulator 154, first hydraulic oil pressurized with the first system pressure of approximately 120 kg/cm$^2$ and discharges the surplus oil from the relief valve 199 to the second system pressure line 159. Here, the first accumulator 154 also plays a role of temporarily storing the hydraulic oil that cannot be instantaneously discharged from the relief valve 199. Hydraulic oil in the first system pressure line 156 mainly plays a role of suppressing the rise of the cushion pad 110 (slightly lowering the cushion pad) at the time of locking, and also plays a role of maintaining the accuracy of the die cushion pressure. This will be described below.

When the slide 14 approaches the bottom dead center and the slide speed decreases, the die cushion pressure decreases accordingly, and the die cushion pressure is then affected by overriding characteristic (pressure reduction characteristic) peculiar to the pilot relief valve 160 functioning by the pilot pressure set in the pilot relief valve 160 acting on the logic valve 158.

Further, according to a die cushion stroke (as the slide 14 approaches the bottom dead center), the hydraulic oil is fed to the first accumulator 154 such that the first system pressure is increased (pressurized). In particular, since the first accumulator 154 can have a relatively small capacity in order to accumulate the small power necessary mainly for the locking process, the pressure is more likely to increase due to the die cushion stroke. Then, the die cushion pressure is generated according to (by adding) the first system pressure having this strong pressure increasing characteristic.

As a result, since the pressure reduction characteristic of the pilot relief valve 160 and the pressure increasing characteristic of the first accumulator 154 simultaneously affect and cancel each other, the die cushion device 100 of this embodiment has an excellent accuracy in the die cushion pressure over the entire die cushion stroke (that is, high smoothness).

In this way, it is preferable that the first accumulator 154 has a capacity that can achieve pressure increasing characteristics suitable for canceling the pressure reduction characteristic of the logic valve 158.

<Pressure Release/Locking Characteristics>

The controller 130 turns OFF the first solenoid valve 164 when the slide 14 of the press machine 10 is moved downward and reaches the bottom dead center or a position slightly higher than the bottom dead center (near the bottom dead center) (refer to portion (C) in FIG. 7). Accordingly, the poppet of the logic valve 158 moves in an opening direction (because the pilot pressure acting (on the pressurized area on the pilot pressure acting side) in a direction of closing the poppet is released to the first system pressure line 156) such that the die cushion pressure is released. The first accumulator 154 accumulates the amount of oil in the die cushion pressure generation chamber 120*a* which has been pushed away due to the moving-down of the hydraulic cylinder 120. Thereby, the die cushion pressure drops to a pressure of around 120 kg/cm$^2$ (that is, a pressure slightly higher than 120 kg/cm$^2$) (arrow $P_A$ in FIG. 7) that is equal to (close to) the sum of the first system pressure which has become higher than a pressure in the standby state and the cracking pressure corresponding to the spring force of the logic valve 158. When the pressure release is completed, the poppet of the logic valve 158 is closed.

Here, the sectional areas of the die cushion pressure generation chamber 120*a* and the cushion pad lowering pressure generation chamber 120*b* of the hydraulic cylinder 120 are set to Sa and Sb, respectively.

In this embodiment, Sa=78.5 cm$^2$, Sb=53.9 cm$^2$. At this time, a force of Fa≈120× Sa=9420 kgf is applied to the die cushion pressure generation chamber 120*a* of the hydraulic cylinder 120, and a force of Fb≈80×53.9=4312 kgf is applied to the cushion pad lowering pressure generation chamber 120*b*. A force of Ft=Fa−Fb=5108 kgf acts on (the whole of) the hydraulic cylinder 120 in the upward direction. This force (reaction force) is indirectly supported by the slide 14 near the bottom dead center (via the upper die 20, the material 30, the blank holder 102, the cushion pin 104, and the cushion pad 110).

Assuming that the slide 14 does not support the reaction force in this state (according to the rising of the slide), the pressure in the die cushion pressure generation chamber 120*a* drops to approximately 54.9 kg/cm$^2$ until the resultant force of 5108 kgf in the upward direction becomes 0 (zero). At this time, the cushion pad 110 is moved upward by the amount corresponding to the elastic release of the hydraulic oil due to the pressure reduction from 120 kg/cm$^2$ to 54.9 kg/cm$^2$. This is a problem in the die cushion device described in Patent Document 1, and the die cushion device 100 of the present invention improves this characteristic.

After the first solenoid valve 164 is turned OFF as described above, the controller 130 turns ON the fourth solenoid valve 171 through the delay time 1 (such that the fourth solenoid valve 171 is turned ON when the pressure in the die cushion pressure generation chamber 120*a* decreases to around 120 kg/cm$^2$ (slightly higher than 120 kg/cm$^2$) as described above) (portion (D) in FIG. 7), and blocks the cushion pad lowering pressure generation chamber 120*b* of the hydraulic cylinder 120 from the second system pressure line 159. Then, the third solenoid valve 175 is turned ON after a delay time 2 (such that the third solenoid valve 175 is turned ON after the fourth solenoid valve 171 is securely turned ON) (portion (E) in FIG. 7). Further, after a delay time 3, the second solenoid valve 172 is turned ON (portion (B) in FIG. 7).

At this time, the force Fa≈180×Sa=6280 kgf is applied to the die cushion pressure generation chamber 120*a* of the hydraulic cylinder 120, and the force Fb≈120×53.9=6468 kgf is applied to the cushion pad lowering pressure generation chamber 120*b*, the force Ft=Fa−Fb=−188 kgf, that is, the downward force of 188 kgf is applied to (the whole of) the hydraulic cylinder 120. Then, this force is applied during the locking time to move the hydraulic cylinder 120 downward to a position slightly (about 0.2 mm in this example) lower than the bottom dead center. At this point, the slide 14 is still near the bottom dead center. The locking position can be easily controlled (with a timer) without sudden lowering (all at once) because the slight downward force acts for a fixed time period of locking time.

After the lapse of the locking time, the second solenoid valve 172 is turned OFF (portion (B) in FIG. 7), and then the third solenoid valve 175 is turned OFF (portion (E) in FIG. 7). In the hydraulic cylinder 120, the pressure of the die cushion pressure generation chamber 120*a* and the pressure of the cushion pad lowering pressure generation chamber 120*b* are stabilized at around 80 kg/cm$^2$ (slightly higher than 80 kg/cm$^2$) and around 120 kg/cm$^2$ (slightly lower than 120 kg/cm$^2$), respectively, such that maintain force balance is maintained in the vicinity of the position lower than the locking position by 0.2 mm.

<Knockout Process>

In the locking process, after the locking has been performed for the fixed time, the controller 130 turns OFF the fourth solenoid valve 171 when the slide 14 reaches 90 mm (in this example) (portion (D) in FIG. 7). As a result, the pressure in the cushion pad lowering pressure generation chamber 120*b* of the hydraulic cylinder 120 drops to the second system pressure and the balance of the forces acting on the hydraulic cylinder 120 (the whole) collapses once. The hydraulic cylinder 120 slightly moves upward and the pressure in the die cushion pressure generation chamber

120*a* slightly decreases (is released) so as to maintain the force balance again (arrow $P_B$ in FIG. 7).

Thereafter, when the slide 14 reaches 100 mm (in this example), the controller 130 turns ON the second solenoid valve 172 and the second solenoid valve 176 (portions (A) and (B) in FIG. 7), and performs the knockout process at a higher speed. At this time, both the die cushion pressure generation chamber 120*a* and the cushion pad lowering pressure generation chamber 120*b* of the hydraulic cylinder 120 communicate with the second system pressure of the second system pressure line 159 of approximately 80 kg/cm$^2$. Therefore, the knockout force Fk≈80×(Sa−Sb) =1968 kgf can work.

Thereafter, when the slide 14 reaches 140 mm (in this example), the controller 130 turns OFF the second solenoid valve 176 (portion (A) in FIG. 7) to reduce the knockout speed (slow down) such that the cushion pad 110 gradually reaches (impacts) the upper limit (standby position). This slow down action is effective in preventing the product from falling. When it is not necessary to change the rising speed of the cushion pad 110, a plurality of second solenoid valves (the two second solenoid valves 172, 176) may be configured by one second solenoid valve.

The one cycle process of the die cushion device 100 is terminated after the standby process, the impact/die cushion process, the pressure releasing/locking process, and the knockout process, described above.

<Others>

In this embodiment, when the cushion pad 110 is locked in the vicinity of the bottom dead center, a downward pressure is applied to the hydraulic cylinder 120 due to the differential pressure between the first system pressure and the second system pressure, and the cushion pad 110 is held below the bottom dead center of the slide (that is, complete locking is performed). However, when the cushion pad 110 does not affect the press forming even if the cushion pad 110 is locked at a position slightly higher than the bottom dead center (that is, even if complete locking is not performed), the solenoid valve may be controlled so as not to apply the downward pressure to the hydraulic cylinder 120 during the locking.

That is, even when the slide 14 reaches the vicinity of the bottom dead center, the second solenoid valves 172 and 176 are kept in the closed state. Thereby, the supply of the hydraulic oil of second system pressure to the die cushion pressure generation chamber 120*a* of the hydraulic cylinder 120 is shut off and the cushion pad 110 is locked. In addition, after the locking for a fixed period, when the cushion pad 110 is moved upward, the second solenoid valves 172, 176 are opened such that the hydraulic oil of second system pressure can be supplied to the die cushion pressure generation chamber 120*a* and the cushion pad lowering pressure generation chamber 120*b* of the hydraulic cylinder 120 to move the cushion pad 110 upward.

Further, in this embodiment, oil is used as a hydraulic fluid for the die cushion device. However, the present invention is not limited to this. Water or other liquid may be used. That is, in the embodiment of the present application, the hydraulic cylinder and the hydraulic closed circuit are used, but the invention is not limited to these. Needless to say, hydraulic cylinders and hydraulic closed circuits using water or other liquids may be used in the present invention. Further, the die cushion device according to the present invention can be applied not only to the crank press, but also to any type of press machine including a mechanical press.

Further, the hydraulic cylinder disposed in the cushion pad is not limited to one place in the above embodiment. Hydraulic cylinders may be disposed, for example, at two places in front of and behind the cushion pad, or four places in front, back, left and right of the cushion pad.

Further, the present invention is not limited to the above examples. Needless to say, various improvements and modifications may be made without departing from the gist of the present invention.

What is claimed is:

1. A die cushion device comprising:

a cushion pad;

a fluid-pressure cylinder configured to move the cushion pad up and down; and a fluid-pressure closed circuit, the fluid-pressure closed circuit including:

a die cushion pressure generation line connected to a die cushion pressure generation chamber of the fluid-pressure cylinder;

a first system pressure line connected to a first accumulator which is configured to accumulate hydraulic fluid having first system pressure capable of performing a lowering process of the fluid-pressure cylinder;

a lowering pressure generation line connected to a cushion pad lowering pressure generation chamber of the fluid-pressure cylinder;

a second system pressure line connected to a second accumulator which is configured to accumulate hydraulic fluid having second system pressure lower than the first system pressure, the second system pressure line capable of performing a knockout process;

a pilot drive type logic valve provided between the die cushion pressure generation line and the first system pressure line, and operable as a main relief valve when a die cushion process is performed; and a pilot relief valve provided between the die cushion pressure generation line and the first system pressure line, and configured to generate pilot pressure for controlling the logic valve, wherein hydraulic fluid is filled in the fluid-pressure closed circuit in a pressurized manner, wherein the fluid-pressure closed circuit does not include a fluid-pressure pump configured to pressurize and feed the hydraulic fluid, and wherein, in the first system pressure line and the second system pressure line in the fluid-pressure closed circuit, the hydraulic fluid can be pressurized by using only die cushion force applied from the cushion pad through the fluid-pressure cylinder, in one cycle period of the cushion pad, including the die cushion process and the knockout process.

2. The die cushion device according to claim 1, further comprising a first solenoid valve configured to switch pressure acting on a pilot port of the logic valve, to any one of the pilot pressure and the first system pressure during one cycle period of the cushion pad.

3. The die cushion device according to claim 2, wherein the first solenoid valve is a poppet type solenoid valve.

4. The die cushion device according to claim 2, further comprising a second solenoid valve that enables opening and closing between the die cushion pressure generation line and the second system pressure line.

5. The die cushion device according to claim 4, wherein the second solenoid valve is a poppet type solenoid valve.

6. The die cushion device according to claim 4, further comprising:

a third solenoid valve that enables opening and closing between the lowering pressure generation line and the first system pressure line; and a fourth solenoid valve that enables opening and closing between the lowering pressure generation line and the second system pressure line.

7. The die cushion device according to claim 6, wherein the third solenoid valve and the fourth solenoid valve are poppet type solenoid valves.

8. The die cushion device according to claim 4, further comprising a controller configured to control the first solenoid valve and the second solenoid valve, wherein the controller controls the first solenoid valve such that the pilot pressure is applied to the pilot port of the logic valve during lowering period of the cushion pad, and controls the second solenoid valve during raising period of the cushion pad.

9. The die cushion device according to claim 6, further comprising a controller configured to control the first solenoid valve, the second solenoid valve, the third solenoid valve and the fourth solenoid valve, wherein the controller controls the first solenoid valve such that the pilot pressure is applied to the pilot port of the logic valve during lowering period of the cushion pad, generates a die cushion force on the cushion pad by the fluid-pressure cylinder, controls the first solenoid valve, the second solenoid valve, the third solenoid valve and the fourth solenoid valve such that the cushion pad stops at or below a bottom dead center between the lowering period of the cushion pad and raising period of the cushion pad, and controls the second solenoid valve during the raising period of the cushion pad.

10. The die cushion device according to claim 8, wherein a plurality of the second solenoid valves are provided in parallel between the die cushion pressure generation line and the second system pressure line, and wherein the controller individually controls opening and closing of the plurality of second solenoid valves during the raising period of the cushion pad, to control a rising speed of the cushion pad.

11. The die cushion device according to claim 1, further comprising a throttle valve for fluid feeding and system pressure sealing in the die cushion pressure generation line, the first system pressure line, the second system pressure line, and a pilot pressure generation line having the pilot relief valve.

12. The die cushion device according to claim 1, further comprising a feeding fluid device which includes:

a tank configured to store the hydraulic fluid;

a discharge port for feeding the hydraulic fluid into the fluid-pressure closed circuit;

a return port for receiving the hydraulic fluid returned from the fluid-pressure closed circuit, the return port being connected to the tank; and a fluid-pressure pump configured to supply the hydraulic fluid from the tank to the fluid-pressure closed circuit through the discharge port, wherein the fluid-pressure pump is driven only when the hydraulic fluid is filled in the fluid-pressure closed circuit in a pressurized manner.

13. The die cushion device according to claim 12, wherein the feeding fluid device includes an extension hose to be connected to at least one of the discharge port and the return port, wherein a coupler is provided at each of both ends of the extension hose.

14. The die cushion device according to claim 11, further comprising a coupler connected to the throttle valve.

* * * * *